US005214815A

United States Patent [19]

Agbodoe et al.

[11] Patent Number: 5,214,815

[45] Date of Patent: Jun. 1, 1993

[54] SURGICAL HEADREST WITH REMOVABLE FOAM PAD

[75] Inventors: Victor B. Agbodoe, Boston; Robert E. David, Duxbury, both of Mass.

[73] Assignee: Codman & Shurtleff, Inc., Randolph, Mass.

[21] Appl. No.: 936,971

[22] Filed: Aug. 28, 1992

[51] Int. Cl.[5] ..... A47G 9/00

[52] U.S. Cl. ..... 5/637; 5/622

[58] Field of Search ..... 5/622, 637, 638, 640, 5/636, 490; 297/391; D6/601

[56] References Cited

U.S. PATENT DOCUMENTS

| | | | |
|---|---|---|---|
| 2,239,003 | 4/1981 | Jones | 5/638 |
| 2,452,816 | 4/1948 | Wagner | 5/637 |
| 2,461,434 | 2/1949 | Moyers | 5/638 |
| 3,188,079 | 6/1965 | Boetcker et al. | 5/622 |
| 4,108,426 | 8/1978 | Lindstroem et al. | 5/637 |
| 4,545,572 | 10/1985 | Day | 5/637 |

OTHER PUBLICATIONS

Codman Surgical Products Catalog, 1990, pp. N-41 and N-42.

*Primary Examiner*—Alexander Grosz
*Attorney, Agent, or Firm*—Michael Q. Tatlow

[57] ABSTRACT

A surgical headrest which comprises two arcuate base segments and a pad affixed to each of the base segments. Each of the pads has a cavity in the surface which is affixed to the base in a shape to accept the base segment, thereby securing the pad to the base segment.

1 Claim, 2 Drawing Sheets

SURGICAL HEADREST WITH REMOVABLE FOAM PAD

FIELD OF THE INVENTION

This invention relates to a headrest for holding the head of a patient, either an adult or a child, during a surgical procedure on the head of the patient.

BACKGROUND OF THE INVENTION

The present invention is directed to a surgical headrest of the type which is commonly referred to as a horseshoe headrest. The headrest employs padded material around a frame which is generally in the shape of a horseshoe and the patient's head is normally positioned face down and cradled by the padded material. This type of headrest differs from the type of headrest that uses skull pins which are driven into the skull of the patient to hold the patient in position or uses pressure pads to hold the head in position.

Typical of such headrests are those disclosed in U.S. Pat. No. 4,108,426 which includes both pins and pads. The headrest shown in U.S. Pat. No. 4,545,572 is particularly adapted for children or infants and uses pads only to support the head in the proper position.

In addition to the above mentioned prior art headrests there is also been available a headrest made with arcuate shaped metal brackets to which foam pads are affixed by pressure sensitive fasteners such as hook and loop fasteners such as VELCRO fasteners. This headrest uses nylon hook fasteners secured to the metal portion of the bracket and a fibrous loop fastener which is secured to a foam rubber pad which can be then attached to the nylon hook fasteners to secure the pad in place. Although this type of device has been successful, there is a tendency of the nylon hook fasteners to be displaced if there is excessive movement of the head during the surgical procedure. In addition, the pads were configured in such a fashion that it is sometimes difficult to place the head of the patient in the proper position. Also, repetitive sterilization with ethylene oxide tends to degrade adhesives used to secure the fasteners to the metal brackets.

BRIEF SUMMARY OF THE INVENTION

The present invention provides a padded horseshoe headrest in which the pads are secured to the bracket by employing a cavity in the pad which matches the cross-sectional configuration of the bracket. In addition, the foam pads have a head contacting surface that is more appropriately shaped to support the head of the patient.

The bracket is made in two sections which are mirror images of each other and which when connected provide the horseshoe configuration of the headrest. One of the sections is directly attached to a support which is directly or indirectly attached to the operating room table. The bracket is provided with a pin to which the second section is attached. The second section can be adjusted along the length of the pin to adjust the bracket to support heads of different dimensions. In using the headrest, the patient is normally positioned faced down with the top of the patient's head toward the support.

DESCRIPTION OF THE DRAWINGS

The invention can be better understood with reference to the following drawings in which.

DETAILED DESCRIPTION OF THE INVENTION

Figure 1:
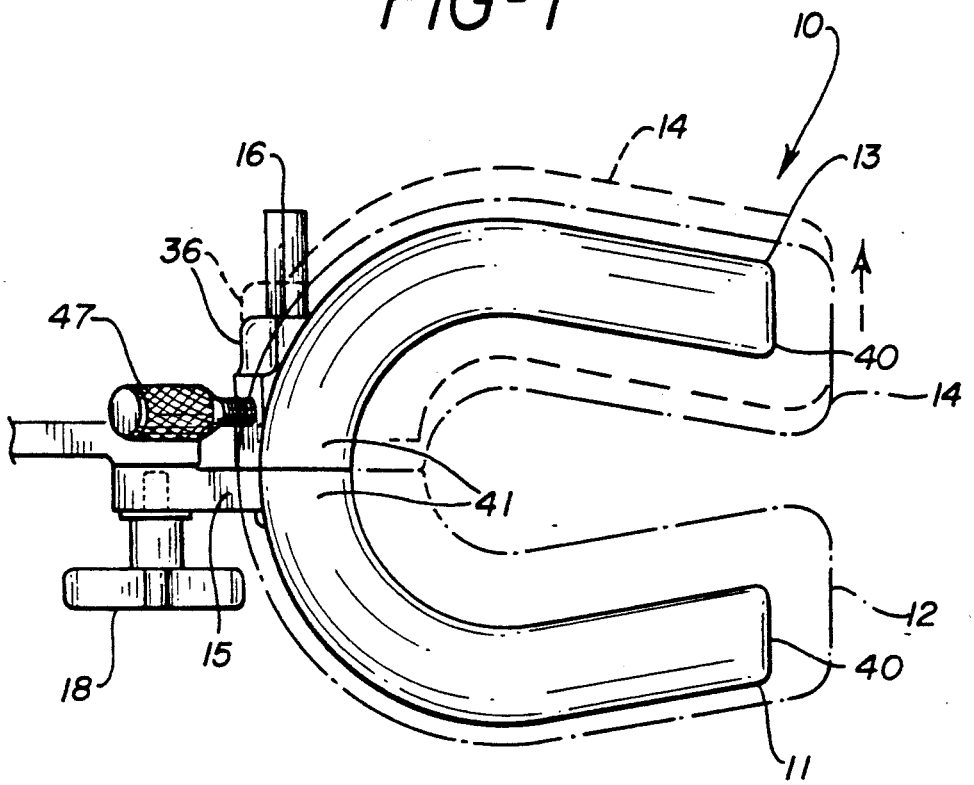
FIG. 1 is a top plan view of the headrest of the present invention showing the pads in phantom.
Figure 2:
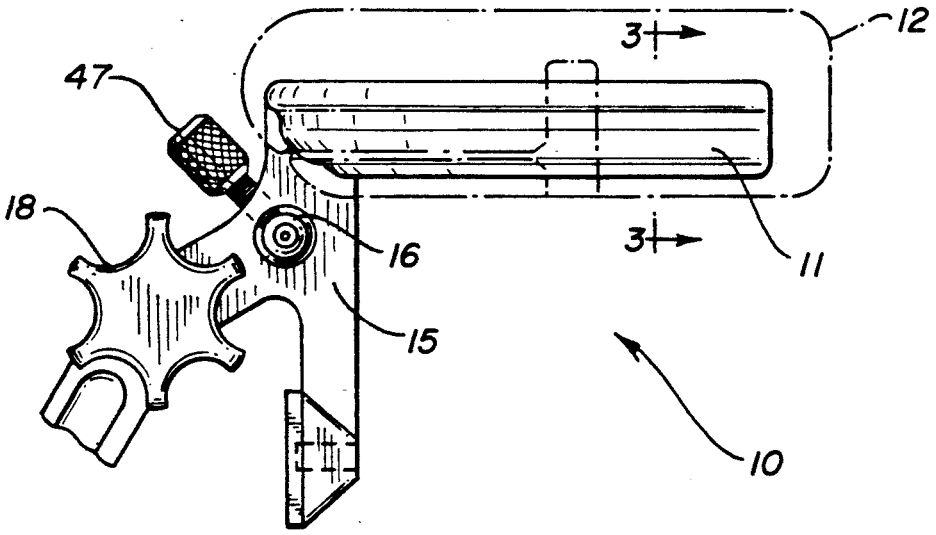
FIG. 2 is a side view of the horseshoe headrest of the present invention with the pads being shown in phantom.

The headrest 10 of the present invention comprises an arcuate base section 11 covered by a pad 12 shown in phantom in FIG. 1. There is a corresponding arcuate base section 13 which is a mirror image of the base section 11 and a corresponding pad 14 affixed to the arcuate base section 13. The arcuate base section is directly mounted to a bracket 15. There is a pin or bar slide 16 which is secured to the bracket 15. The arcuate base section 13 has a tubular extension 36 through which the bar slide 16 is fitted. There is a thumb screw 47 mounted in the extension 36 which can be tightened to secure the arcuate base section 13 to the bar slide 16. The bar slide 16 is preferably a rectangular bar and the thumb screw 37 is positioned in the extension 36 so that it engages a flat side of the bar to hold arcuate section 13 in position. The distance between the two arcuate sections of the headrest can be adjusted by releasing the thumb screw and moving arcuate section 13 the proper distance from the fixed arcuate base section 11 to adjust the space to fit a particular patient's head.

The bracket 15 has a sunburst clamp 18 which is used to affix the bracket either directly or indirectly to the operating room table. There is also a second sunburst ratchet which can be .used to affix a pulley bar (not shown) to the bracket. The pulley bar is used to attached weights to counterbalance the weight of the patient's head on the support.

When the two arcuate sections are in place, they are in a horseshoe shape in the sense that the distance between the center line of the segments is less at their free ends 40 then it is at the ends 41 which are adjacent to the bracket 15.

Figure 3:
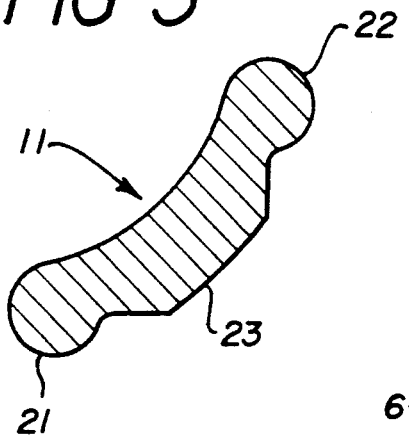
FIG. 3 is a cross section of the configuration of the bracket taken along lines 3—3 of FIG. 2.
Figure 4:
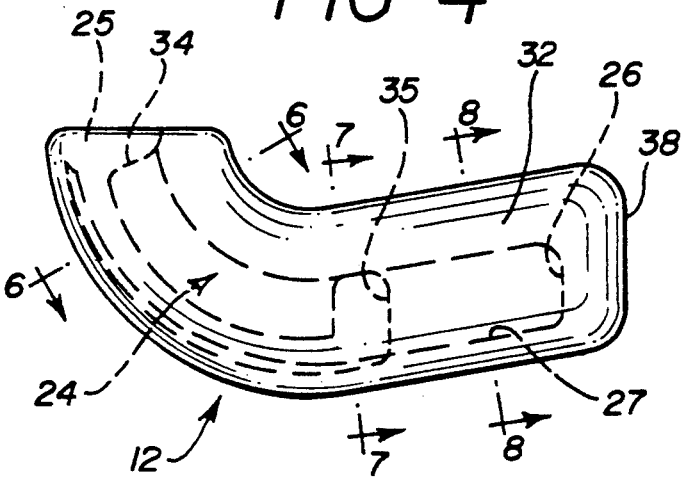
FIG. 4 is a top view of a left side pad employed in the headrest of the present invention.
Figure 5:
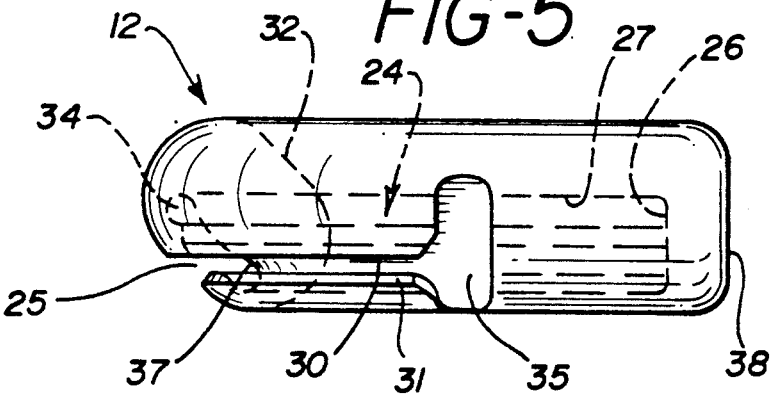
FIG. 5 is a side view of the left side pad of the present invention.
Figure 6:
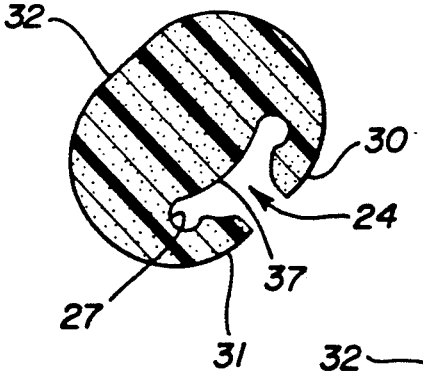
FIGS. 6, 7 and 8 are taken along the lines of 6—6, 7—7 and 8—8 of FIG. 4.
Figure 7:
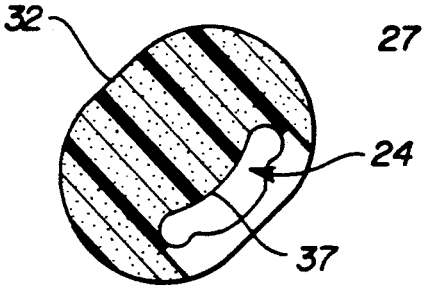
Figure 8:
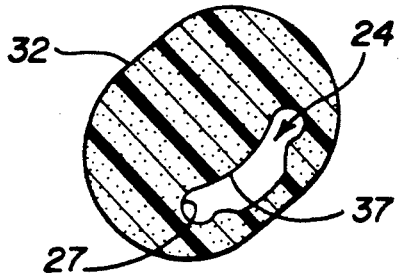

The arcuate sections have a cross-sectional configuration which is shown in FIG. 3. The cross sectional configuration has two ends 21 and 22 which are preferably rounded and a center segment 23 which joins the ends. It is preferred if the cross section of the bracket be an irregular shape to better secure the headrest pads to the arcuate sections.

The headrest pads, as shown in FIG. 4 - FIG. 8, include a cavity 24 which extends longitudinally along the greater portion of the length of the pad. The cavity has an open end 25 and a closed end 26. There is a longitudinal slot 27 cut in the pad from the open end of the cavity 25 and extending toward the closed end of the cavity 26. There is also a transverse slot 34 at the open end of the cavity and a second transverse slot 35 spaced at some distance from the first transverse slot. These positions of the transverse slots creates two flaps 30 and 31 which are flexible and provide ease of affixing the pads to the arcuate sections. Each pad has an inward facing surface 32 on which the head of the patient rests.

There is an opposed surface to the pad to which contains the longitudinal slot 27. The pad has an arc portion 37 corresponding to the concave portion in the arcuate sections. The end of the pad 38 is preferably closed so that the arcuate sections will not be in contact with the patient.

The inwardly facing surface of the pad is set at an angle which corresponds to the angle of the arcuate section as measured between a plane passing through the ends 21 and 22 of the arcuate sections and a plane passing perpendicularly through the pin or bar slide 16. This angle is between 30° and 60° preferably about 45°.

The pads are mounted on the arcuate sections by pushing the arcuate sections into the transverse slots 34 at the open end of the pad. The flaps 30 and 31 are flexible enough to be moved so that the arcuate base sections can be fitted into the cavity 24. Once the pads are fitted onto the arcuate sections there is little likelihood that they will move during the surgical procedure. They are very securely fastened to the metal portion of the headrest.

The pad itself is made from a polyester foam material which has a desired flexibility for use as a headrest.

What we claim:

1. In a surgical headrest of the type including a bracket for attachment of the headrest to an operating room table, a first arcuate base segment having a first end affixed to said bracket and a second free end, an elongate pin affixed to said bracket, a second arcuate base segment having a curvature which is the mirror image of the curvature of said first arcuate segment and having a first end adapted to be movably secured to said elongate pin to adjust the size of the headrest and a second free end, each of said base segments having an inwardly facing surface and an opposed outwardly facing surface and a top edge and a bottom edge, each inwardly facing surface being concave and each opposed surface being irregular, said concave surface being set at an angle of between 30 and 60 degrees as measured between a plane passing through the top and bottom edges at the free ends of said base segments and a plane perpendicular to the axis of said elongate pin, a headrest pad having an inwardly facing side and an opposed side, the improvement comprising a cavity in said pad which extends along the length of said pad, said cavity having an open end and a closed end and a cross sectional configuration which is congruent with the cross sectional configuration of the base segment to which said pad is affixed, the inwardly facing surface of said pad being at an angle substantially equal to the angle of the concave surface of the base segment to which it is affixed, a longitudinally extending slot on said opposed side of said pad extending along a portion of the length of said pad, a first transverse slot at the open end of said cavity and a second transverse slot spaced from said first transverse slot along the length of said longitudinally extending slot, said longitudinally extending slot and said transverse slots joining with said cavity to receive the arcuate segments and thereby affix said pads to said arcuate segments.

* * * * *